US005343739A

United States Patent [19]

Curry

[11] Patent Number: 5,343,739

[45] Date of Patent: Sep. 6, 1994

[54] GANTRY CRANE COLLISION AVOIDANCE DEVICE

[76] Inventor: John R. Curry, 419 E. Walnut Ave., El Segundo, Calif. 90245

[21] Appl. No.: 102,915

[22] Filed: Aug. 6, 1993

[51] Int. Cl.[5] ..... B66C 15/04

[52] U.S. Cl. ..... 212/151; 340/436; 340/942; 212/149

[58] Field of Search ..... 212/149, 151, 153, 218, 212/219, 220; 340/436, 685, 942

[56] References Cited

U.S. PATENT DOCUMENTS

| | | | |
|---|---|---|---|
| 2,366,152 | 12/1944 | Lauterbach | 340/942 |
| 2,708,715 | 5/1955 | Meyers | 212/132 |
| 3,138,357 | 6/1964 | Whitwell et al. | 340/685 |
| 3,372,816 | 3/1968 | Atwater . | |
| 3,502,232 | 3/1970 | Hartman . | |
| 3,582,933 | 6/1971 | Place | 340/685 |
| 3,881,602 | 5/1975 | Altherr . | |
| 4,030,088 | 6/1977 | McCullough . | |
| 4,408,195 | 10/1983 | Tullis et al. | 212/153 |
| 4,504,918 | 3/1985 | Axmann . | |
| 4,675,664 | 6/1987 | Cloutier . | |
| 4,950,118 | 8/1990 | Mueller . | |
| 4,973,158 | 11/1990 | Marsh . | |
| 5,048,703 | 9/1991 | Tax . | |

FOREIGN PATENT DOCUMENTS

| | | |
|---|---|---|
| 1082837 | 6/1960 | Fed. Rep. of Germany . |
| 2642181 | 12/1979 | Fed. Rep. of Germany . |

*Primary Examiner*—Michael S. Huppert
*Assistant Examiner*—Thomas J. Brahan
*Attorney, Agent, or Firm*—Fulwider, Patton, Lee & Utecht

[57] ABSTRACT

A transmitter attached to the overhang of a hoisting crane that is movable over rails. The transmitter is operative to transmit signals to receivers also mounted on the hoisting crane. During movement of the crane, the signals may be blocked by objects that may come between the transmitter and receivers indicating a pending collision. The receivers upon detecting a blockage are operative to alert the operator of the unsafe condition and deactivate the gantry motors moving the crane.

19 Claims, 8 Drawing Sheets

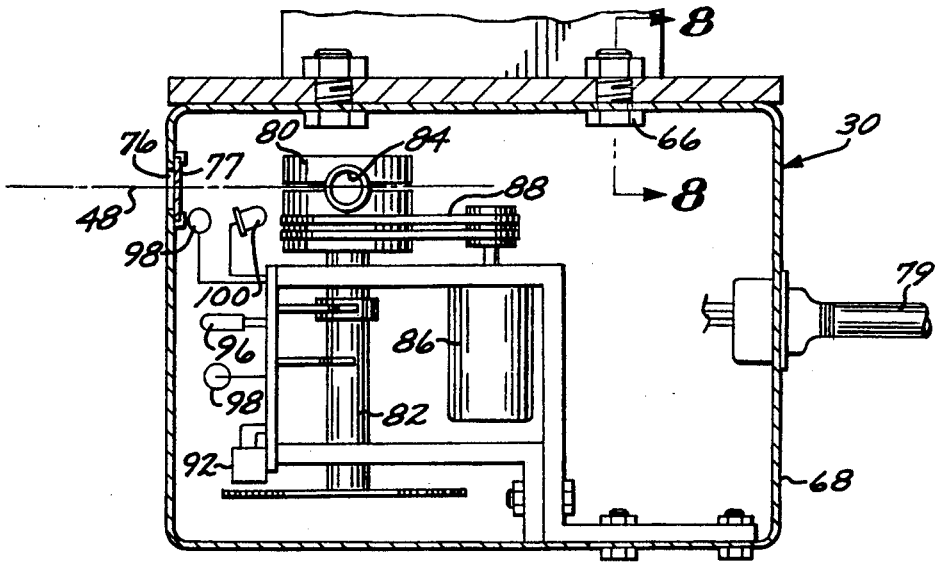
FIG. 5
FIG. 6
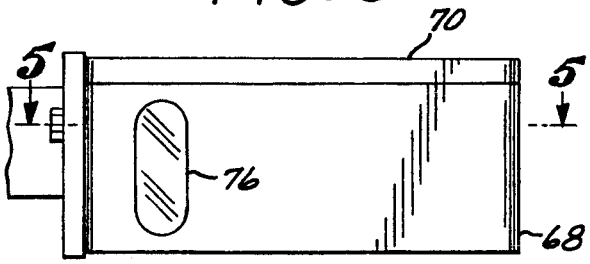
FIG. 7
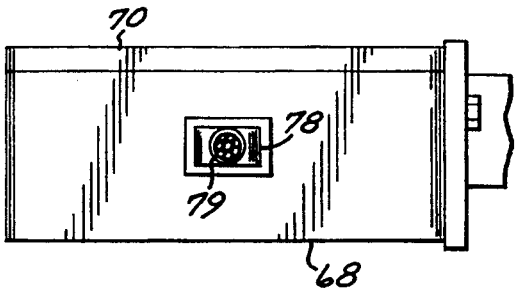
FIG. 8
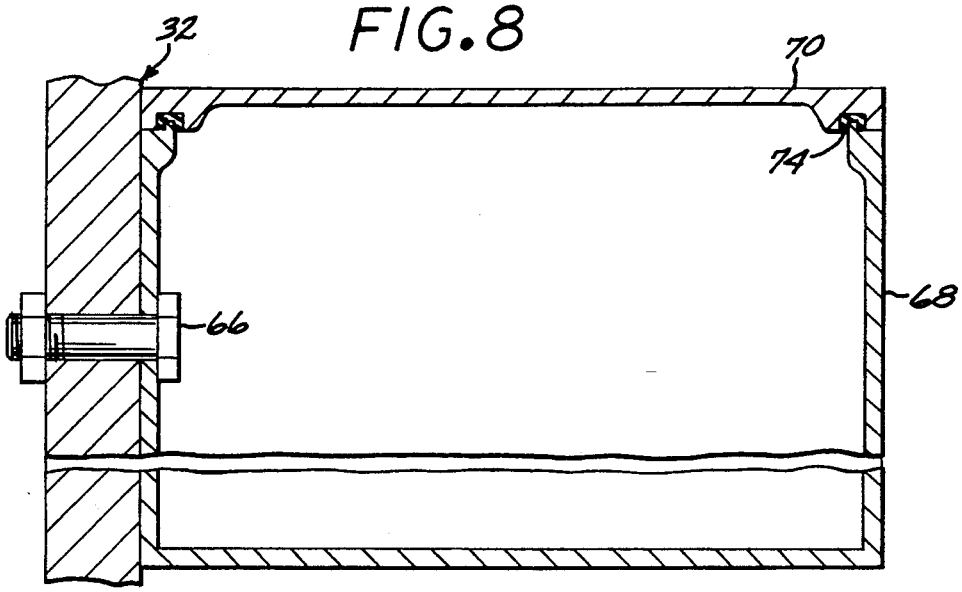

| INPUT | | OUTPUT | | | |
|---|---|---|---|---|---|
| | | LEDS | | | |
| CHANNEL 1 VERIFICATION SIGNAL 152 | CHANNEL 2 VERIFICATION SIGNAL 153 | LEFT 155 | CENTER 156 | RIGHT 157 | OPERATION CIRCUIT 158 |
| LOW "0" | LOW "0" | OFF | OFF | OFF | OPEN CIRCUIT |
| HIGH "1" | LOW "0" | OFF | OFF | ON | GROUNDED |
| LOW "0" | HIGH "1" | ON | OFF | OFF | GROUNDED |
| HIGH "1" | HIGH "1" | OFF | ON | OFF | GROUNDED |

FIG. 16

GANTRY CRANE COLLISION AVOIDANCE DEVICE

BACKGROUND OF THE INVENTION

1. Field of the Invention

The present invention relates generally to cargo transfer cranes and particularly to a mobile hoisting crane for loading and unloading cargo ships.

2. Description of the Prior Art

Used upon a dock at a harbor installation, a cargo gantry crane provides a vital link in the movement of goods between land based transportation systems and sea-going vessels by accomplishing the Herculean task of loading and unloading cargo therebetween. Typically, such gantry cranes move along rails that run lengthwise alongside a ship by means of a self-propelled wheel-type motor bed. A vertical gantry tower rises above the motor bed to support a horizontal load-bearing cantilevered boom, such that the free end of the boom may hang over a ship's hold. Cargo is hoisted by means of a spreader suspended from a trolley coupled to the boom. The trolley moves the hoisted cargo between the ship and the dock lengthwise along the underside of the boom. The crane is operated from a cab suspended high overhead attached to the trolley. When not in use, the gantry boom includes a pair of pivot pins positioned in front of the tower that enable the free end of the boom to rotate on a horizontal axis in a drawbridge like fashion to a vertical position thereby creating an unobstructed berth for the ships while docking.

Typically, one or two gantry cranes handle the task of loading or unloading cargo, whereby such cranes must access several hatches to the ship's hold. Such a scheme requires the gantry crane to selectively move lengthwise alongside the ship in order to position the boom over each of the hatches. During such maneuvers, the gantry crane operator ensures the boom remains unobstructed by relatively stationary vertically-extending objects, such as the ship's masts and radar antennas. Additionally, longshoremen and trucks may obstruct the ground path of the gantry crane, so it is also very important for the operator to direct his or her attention to the rails to avoid injury to people or other objects that may be in the path of the crane as it gantries along the rails. Focus of the operator's attention on the ground path may divert his attention from the gantry boom as it translates over the ship.

A collision of the gantry boom during movement of the gantry crane can damage the crane or, more frequently, inflict severe damage to the ship's mast or radar antenna. This can affect the sea worthiness of the ship thus dictating that the ship remain in port until repairs are completed. In out of the way ports, where repair services are not readily obtainable with any degree of dispatch, this problem can work a severe economic hardship on the ship's operation. The time lost by the ship laying in port may even have a greater economic impact than the cost of repairs on the ship's operation. Thus, it has long been established that there exists a need for a reliable system for detecting the approach of the crane on obstacles in the gantry boom's path so that progress of the crane can be interrupted pending clearance of the path.

In recognition of this need, devices have been proposed to detect objects located in the path of a cargo gantry crane. One such system, sold by Bewa, Inc., Sharon, Pa., for bewa-GmbH of Germany, under the model designation Colwar III, employs an array of ultrasonic receivers arranged lengthwise along a gantry crane boom in spaced apart relation to detect the boom moving near an object. Because such receivers have a limited detection range, the length of the boom dictates the number of receivers required for adequate coverage. These receivers tend to be costly and for larger cranes may be cost prohibitive because of the extensive number of receivers required along the boom. Additionally, the receivers may be subject to error due to interference caused by the trolley moving along the boom.

Similarly, devices have been proposed to determine the position of a spreader in relation to objects underlying the spreader for the lowering of cargo thereon. In Tax et. al., U.S. Pat. No. 5,048,703, a container crane installation is disclosed having a remote recognition system and a position recognition system fitted on a spreader suspended by rigging from a crane trolley. The remote recognition system ascertains the distance of the spreader from the objects in the spreader's path, such as a ship's hatch, hold or cargo containers, by calculating the round-trip time of a pair of laser pulses projected from the spreader to the object and back. Intended to ascertain the position of the spreader with respect to the trolley, the position recognition system determines the distance and pitch of the spreader in relation to the trolley by calculating the round-trip time and lateral displacement of a pair of reflection beams projected from the spreader to the trolley and back. In each of the recognition systems disclosed, the respective beams are directed along the vertical path of a spreader at objects having large planar surfaces that provide ideal identifiable reflective surfaces. Such systems do not overcome the problem of detecting a vertically extended object in the path of a gantry boom, such as a ship's mast with a small cylindrical surface, where such an object provides a poor or non-reflective surface.

Thus, the need exists for a cost effective reliable system to detect objects that may appear in the path of the gantry crane as it gantries lengthwise alongside a ship. Such a system must be capable of detecting objects, error free, even under extreme weather conditions, in dirty and dusty environments and while other lighting devices are operating near the gantry crane.

SUMMARY OF THE INVENTION

The present invention provides a low cost and low maintenance collision avoidance apparatus that detects and warns of vertically extended objects, such as a ship's mast, located in the path of a gantry crane boom during movement of a gantry crane laterally alongside a ship and upon detection of such object provides a warning signal. The subject invention includes transmitters mounted on opposite sides of the free end of a gantry crane boom for directing their respective laser beams rearward towards a plurality of photo-electric receivers mounted in vertical spaced apart relation on respective legs of a gantry crane tower. By directing the respective laser beams at the respective tower leg's receivers, the laser transmitters define boundary paths to the respective tower leg's receivers positioned to define the extent of respective danger fields for providing detection and warning of intrusion in such fields by vertically extended objects, such as a ship's mast.

In the presently preferred embodiment, a pair of laser transmitters is mounted on each side of the free end of the gantry crane boom and include respective lasers that rotate like beacons to radially project respective vertically sweeping laser beams in a fan-like pattern toward the respective tower legs. The receivers mounted on each tower leg detect the intrusion of an object into their associated boundary paths by detecting the absence of a laser pulse. Upon any of the receivers detecting the absence of the laser pulse, the receiver transmits a continuous digital response signal to its respective logic circuit connected in circuit with the receivers mounted on each of the respective tower legs. The response signal is generated continuously until the receiver generating the response signal detects the presence of the laser beam. The respective logic circuits distinguish vertically extended objects, such as a ship's mast, from birds or air-borne debris by logically processing the response signals from the respective tower leg's receivers and integrating the response signals with a preset threshold signal level. Objects such as a bird and other air-borne debris do not cause the generation of a response signal above the threshold signal level. Intrusion of vertically extended fixed objects, such as a ship's mast, into the danger field, generate a response signal above the threshold level which in turn triggers respective relays which shutdown the prime movers on respective sides of the gantry crane motor bed and simultaneously sound an alarm alerting the operator of such an intrusion.

After the gantry crane has stopped, the respective logic circuits also function to determine when the respective danger fields are clear by processing the input signals from their associated receivers and, upon determining the respective fields are clear, trigger the respective relays that reestablish operation of the respective prime movers.

Once the gantry prime movers have been shutdown, it can be expected that there will still be several feet of drift that may occur before the crane comes to a complete stop. The present invention accounts for such drift by positioning the receivers on the respective towers to lead in the direction of crane travel and aligning the laser transmitters thereat such that any object in the gantry crane's path may be detected therefrom to allow the crane to stop well in advance of such object.

As an additional feature, the present invention includes laterally extended sensors on each of the respective receivers that cooperate with the respective vertically sweeping laser beams projecting from the lasers to account for variations in the horizontal and vertical direction at which the respective laser beams are projected thereby eliminating alignment errors due to movement of the lasers caused by swaying of the free end of the gantry boom.

Other objects and features of the invention will become apparent in consideration of the following description taken in conjunction with the accompanying drawings.

DESCRIPTION OF THE DRAWINGS

FIG. 5 is a fragmentary top view similar to FIG. 3 but, in enlarged scale, partially cut away along line 5—5 of FIG. 6;

FIG. 6 is a transverse view taken along the lines 6—6 in FIG. 3 showing one end of the transmitter depicted in FIG. 3;

FIG. 7 is a view of the opposite end of the transmitter shown in FIG. 6;

FIG. 8 is a broken view in enlarged scale, taken along the line 8—8 in FIG. 5;

FIG. 16 is a logic table for a receiver demultiplexer incorporated in the collision avoidance device shown in FIG. 14.

DESCRIPTION OF THE PREFERRED EMBODIMENT

Figure 1:
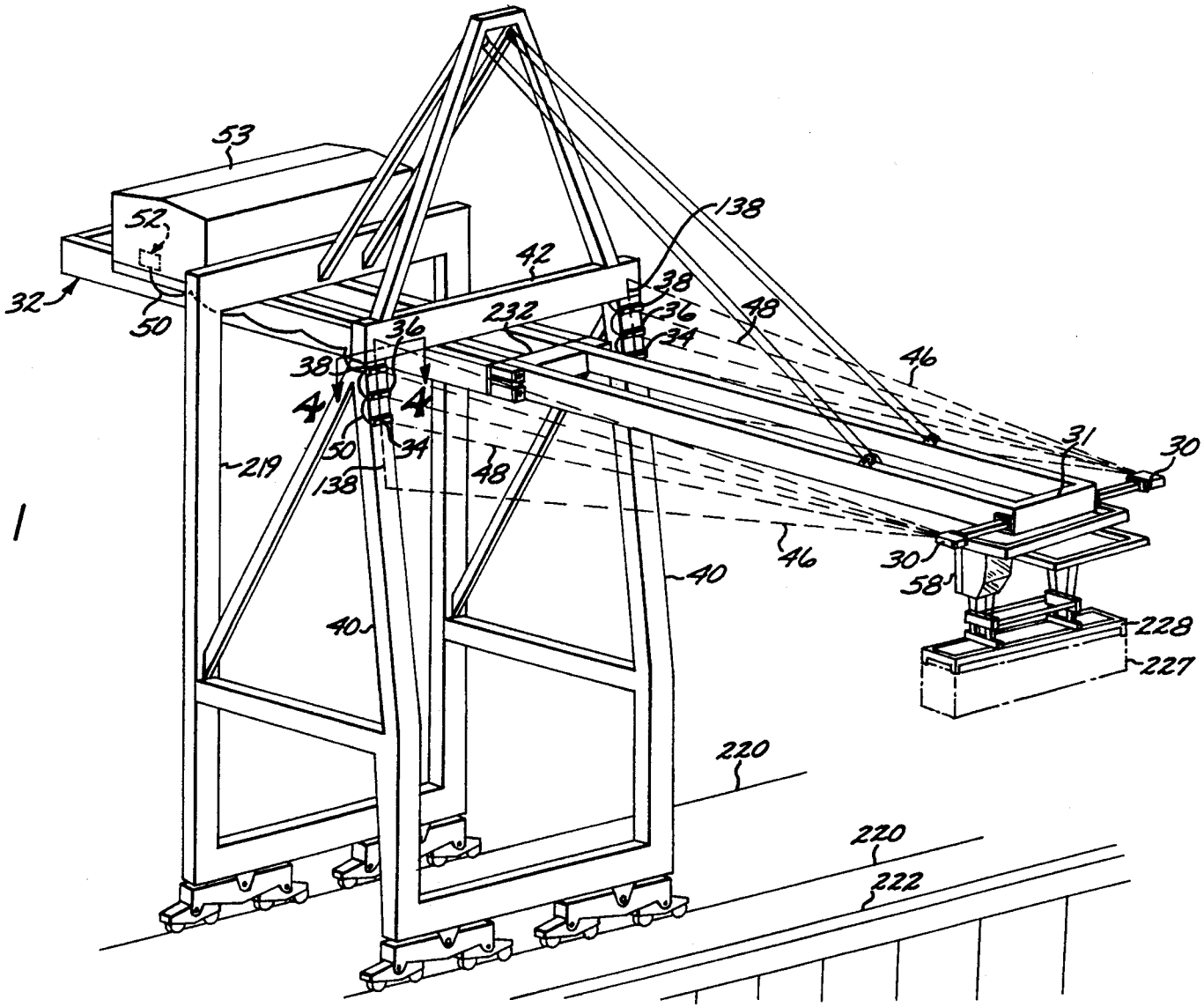
FIG. 1 is a perspective view of a cargo crane embodying the collision avoidance device of the present invention.

As shown in the drawings for purposes of illustration, and with particular reference to FIG. 1, the invention is embodied in laser transmitters, generally designated 30, which are mounted on opposite sides of a whisker pull platform 31 at the free end of a gantry crane boom 32 to transmit respective laser beams rearward toward targets defined by a plurality of photo-electric receivers, generally designated 34, 36, and 38 that are mounted in vertically spaced apart relation on the respective opposite legs 40 of a gantry crane tower 42. Such laser transmitters 30 project their respective laser beams by means of respective rotating laser generators 44 (FIG. 5) radially projecting respective vertically sweeping laser beams in an outwardly diverging fan-like pattern that, when directed lengthwise alongside the boom 32, is detected by the respective tower leg's receivers 34, 36 and 38 in the form of pulsating laser signals. These respective tower leg's receivers 34, 36 and 38 are positioned to define the extent of respective danger fields 46 patrolled by the respective tower leg's receivers along associated boundary paths 48 defined by the respective laser beams when directed thereat. The receivers on the respective tower legs connect in circuit through respective multiple-conductor cables 50 with respective logic controllers, generally designated 52 (FIG. 14), mounted in a gantry motor control 53 (FIG. 1). Such respective logic controllers 52 include respective logic circuits 54 (FIG. 14) that connect to alarms 56 mounted in an operator's cab 58 (FIG. 1) and relay power to respective gantry motor controllers 62 (FIG. 14) on opposite sides of a gantry motor bed. Each of the respective tower leg's receivers 34, 36 and 38 detects the intrusion of an object (not shown) into its associated boundary path, by detecting the absence of a laser pulse. Upon detecting the absence of a laser pulse, each of the respective tower leg's receivers is operative to continuously signal a corresponding digital response signal to the respective logic circuits 54. These respective logic circuits 54 distinguish intrusions in the respective danger fields by vertically extended objects such as a ship's mast from birds or air-borne debris by comparing the response signals from the respective tower leg's receivers to a predetermined threshold and, upon determining the intrusion is due to a vertically extended object, shuts down the prime mover on the respective sides of a gantry motor bed and alerts the operator of such an intrusion.

Referring now to FIGS. 3 and 5–8, the transmitters 30 include respective transmitter housings 64 (FIG. 3) mounted on the opposite sides of the whisker pull platform 31 at the free end of a gantry boom 32 by means of bolts 66 (FIG. 8) to extend laterally 3 to 6 feet in the direction of travel of the boom. Each respective transmitter housing includes a box 68 covered by a lid 70 attached thereto by screws 72 with a gasket 74 sandwiched between to seal against salt air and moisture experienced at the dock. The respective boxes include respective windows 76 (FIG. 6) covered by respective glass window panes 77 and disposed to project the respective laser beams therethrough (FIG. 5) toward the respective tower legs 40. Leading through respective grommets in one wall of the respective boxes, respective power lines (FIG. 7) electrically connect a power supply (not shown), which consists of a commercially available 115 VAC to 12 VDC transformer, to respective laser generators 44 that are housed inside the respective boxes 68 to generate respective laser beams through the respective windows 76 (FIG. 5).

Typically used in landscaping or surveying equipment, each of the respective laser generators 44 (FIG. 5) includes a cylindrical collimator solid-state laser light source (not shown) such as the type manufactured by Philip Electronics, headquartered in The Netherlands, under the model designation 515CQL-A or 515CQL-AH 614-886. Such a laser light source provides a 2 milliwatt, 4 to 5 millimeter circular infra-red beam by means of a low energy, semiconductor, solid-state laser diode of the type found in supermarket scanners that projects laser light through collimating lenses that serve to focus the laser beam. The laser light source mounts on the inside of a fly wheel 80, carried from the end of a rotary drive shaft 82, to radially project the laser beam therefrom through an aperture 84 formed in the cylindrical surface of the fly wheel at precisely 90° to the spin axis of the drive shaft. The drive shaft 82 movably couples to the transmitter housing 64 by a pair of journal and race assemblies (not shown) for rotation by an electric motor 86 with a pair of drive belts 88 causing the laser light source connected therefrom to radially direct a sweeping laser beam at the respective receivers.

With continued reference to each of the respective laser generators 44 (FIG. 5), a disk-shaped opaque laser circuit board 90, formed with concentric spaced apart optic bores (not shown), attaches to the opposite end of the drive shaft 82. During rotation of the laser circuit board 90, a stationary optical sensor 92 sensing the stroboscopic effect of light through the rotating bore holes is operative to determine the frequency of rotation of the drive shaft. Connected in circuit therewith, a rotation-control circuit-board 94 is responsive to the measured frequency of rotation from the optical sensor 92 to maintain the rotation speed of the laser light source at a predetermined reference frequency, 10 revolutions per second (RPS) in the preferred embodiment, by adjusting the voltage load to the drive motor 86 accordingly. This circuit also shuts off laser power when spinning stops to meet safety requirements to prevent injuries due to a long term exposure to a stationary laser source.

A laser generator satisfactory for this application is of the type disclosed in Marsh, U.S. Pat. No. 4,973,158 and sold by Martronic Engineering, Simi Valley, Calif. under the model designation No. 107.

In the preferred embodiment, the respective laser generators include respective mercury switches 96 that operate as inclinometers to render each of such transmitters 30 inoperative upon rising the free end of the boom.

Still referring to FIG. 5, the respective laser generators include heat lamps 98 disposed in heat exchange relationship with the respective window panes 78 to act as defoggers. Respective light sources 100 are focused on the respective rotating fly wheels to illuminate the respective laser sources for viewing through the respective windows to detect operation thereof. A light bulb or light diode is preferred due to its longevity of operation and low cost and to provide for the combination of elements 98 and 100.

As illustrated by FIGS. 4 and 9–13, the respective tower leg's receivers 34, 36 and 38 are positioned and aligned with the laser transmitters 30 to cause the respective boundary paths 48 to lead in the direction of crane travel to detect an object in the respective boundary paths well in advance of the boom 32.

The respective tower leg's receivers are each constructed identically and may all be described witch reference to the lower left side receiver 34 illustrated in FIG. 1. Referring to FIGS. 4 and 9–13, the receiver includes a receiver housing 110 that serves to insulate against salt air and moisture experienced at the dock. The receiver housing 110 includes an outwardly opening rectangular box 112 covered by cover 114 attached thereto by screws. Mounted to the back wall of the box 112 is a pair of rubberized magnets 116 (FIGS. 3 and 9) which serve to magnetically secure the housing 110 to the front face of the tower leg 40 while maintaining the structural integrity of the leg without drilling or welding thereto. Mounted by grommets 118 exteriorly on one side of the box are input 120 and output 122 plugs which connect the receiver 34 with its respective tower leg's logic controller 52 by means of multi-conducting insulated cables 50 that provide power and signal lines. The cover 114 includes a window 124 shielded by a Lexan type window pane 126 for projecting light therethrough.

With continued reference to the lower left side receiver 34 of FIG. 1, the receiver housing houses a pair of laterally extended detector arrays 128 and 129 (FIG. 10) visibly perceptible through the window and positioned in a partially tiered vertical overlapping relationship to form a central sensor region 130 with opposed lateral left side 132 and right side 134 sensor regions disposed on the opposite sides thereof. In the preferred embodiment, each of the detector arrays measures eight inches in lateral length that gives a combined sensor length of twelve inches and four inches of overlap in the center region 130. Mounted exteriorly on the front side of each of the housings are three light emitting diodes (LEDs) 135, 136 and 137 which correspond to the three sensor regions 130, 132 and 134 respectively. Connected in circuit with the detector arrays, such LEDs facilitate centering of the respective receivers along a vertical interface line 138 traced by the invisible infra-red vertically sweeping laser beam along respective tower legs by causing illumination of a center LED 135 in response to the overlapping detector arrays 128 and 129 in the center sensor region 130 detecting the laser beam.

Figure 14:
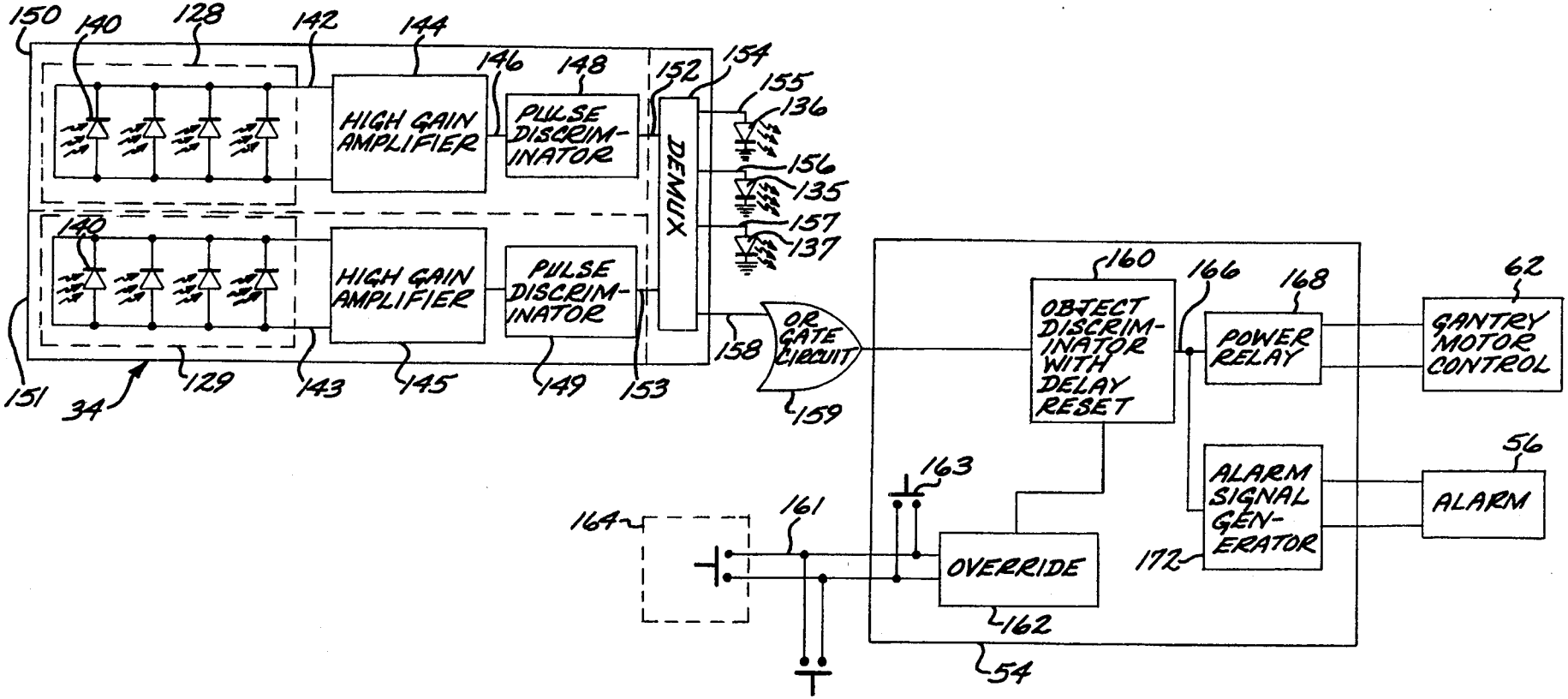
FIG. 14 is a block diagram of a receiver and controller device incorporated in the collision avoidance device shown in FIG. 1.

Illustrated in FIG. 14, the detector arrays 128 and 129 are each defined by associated tightly spaced lateral rows of photo voltaic diodes 140 connected in parallel across the input leads 142 and 143 of associated high gain amplifiers 144 and 145. The output leads 146 and 147 of associated high gain amplifiers connect with the input leads of associated logical pulse discriminators 148 and 149 to form associated pulse channels 150 and 151. The associated pulse channels 150 and 151 respond to the presence or absence laser pulses having a particular amplitude, pulse width and pulse frequency by generating a corresponding "HI" or "LOW" digital signal having a clock cycle that corresponds with the rotation rate of the lasers, 10 Hz in the preferred embodiment. The output leads 152 and 153 of the associated pulse discriminators 148 and 149 connect to associated input leads in a two-state, TTL type, 2 to 4 demultiplexer 154 that responds to the respective Boolean-type input signals to generate a response signal across one of four output lines 155–158 as illustrated in the table of FIG. 16, where three output lines 155–157 connect to the corresponding LEDs 135, 136 and 136 and the fourth output line 158 connects to the input of the logic circuit 54.

This receiver circuitry as described is of the type typically used in landscaping receivers where the grade of the slope may be measured by a rotating laser registering a laser pulse upon a longitudinally extended photo-electric receiver such as the type sold by Martronic Engineering, Simi Valley, Calif. under the model designation Mini-MCS.

Figure 15:
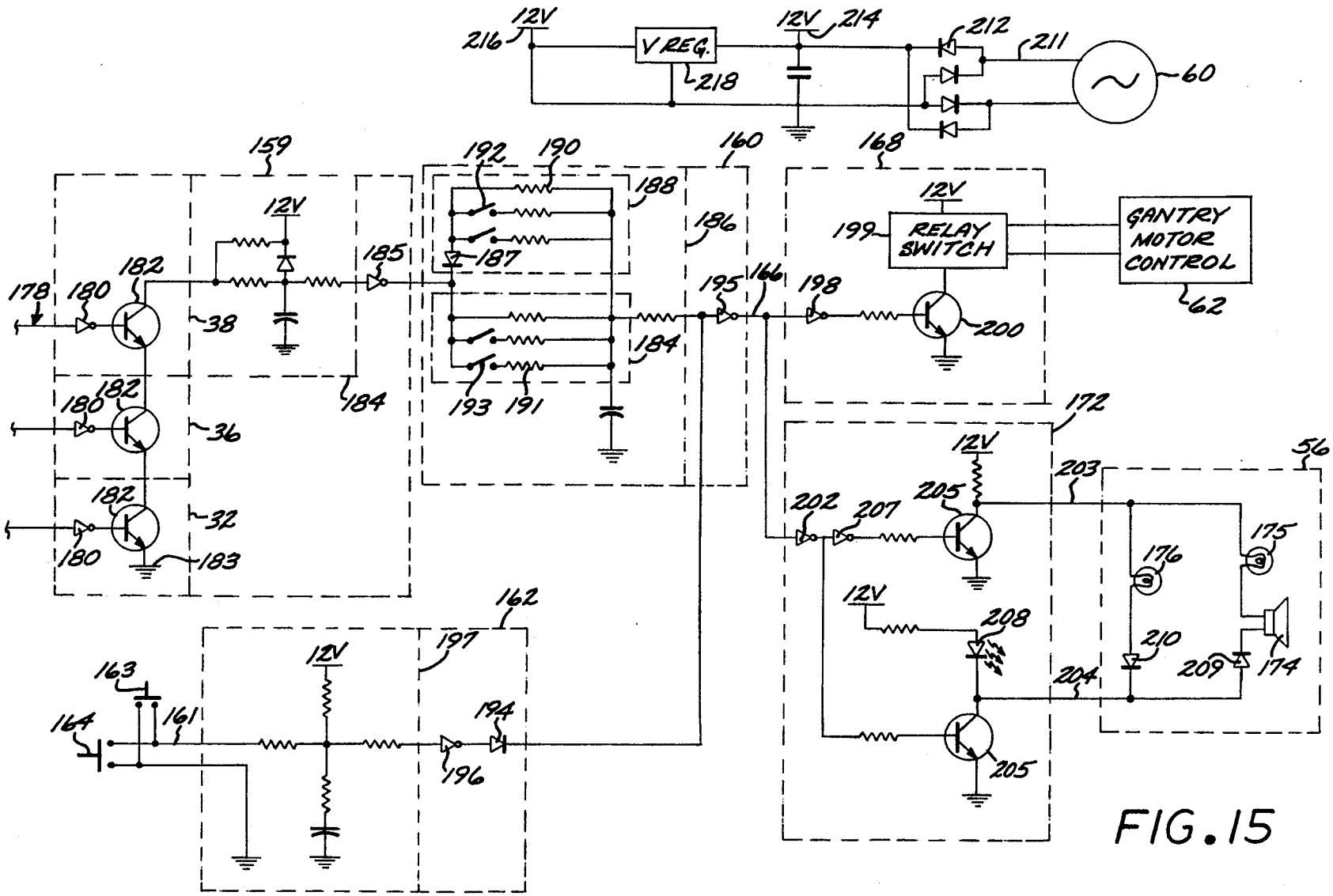
FIG. 15 is a diagram of the circuitry incorporated in the controller device shown in FIG. 14.

The respective tower leg's logic controllers 52 are each constructed identically and may be described with reference to the left side tower leg's logic controller 52 illustrated in FIGS. 14 and 15. The logic controller housed in a typical electrical junction box (not shown) comprises a logic circuit 54 that in response to detecting objects in the boundary path having a predetermined characteristic, shuts down the gantry's motor and alerts the operator of the object. The logic circuit 52 functionally includes a logical gate 159 (FIG. 14) with input that are actually housed in the corresponding receiver and connect to the outputs of the corresponding demultiplexers in the receivers 34, 36 and 38. The output of the OR gate 159 connects to the input of an object discriminator that includes a two-state threshold-triggered-response integrator that generates a control signal upon detecting an object such as a ship's mast. An override 162 connects to the object discriminator and has two leads 161 across which a toggle switch 163 mounted on the logic controller box (not shown), a mercury switch 164 mounted on the gantry crane's boom 32, and an external switch 165 mounted in the operator's cab 58 connect in parallel and upon causing a short-circuit across the input leads 161 disables the control signal. The output 166 of the object discriminator 160 connects in parallel to a power relay 168 operative to disable power at the respective gantry motor controllers 62 to the respective gantry motors on opposite sides of the motor bed 170 and a two-state two-output alarm-signal generator 172 operative to signal audio 174 and visual alarms 175 and 176 in the operator's cab (FIG. 15).

Although principally housed in the logic controller 52 (FIG. 1), the OR gate 159 (FIG. 15) is made up of a circuit that includes modular inputs 178 in each of the corresponding receivers 34, 36 and 38 defined by buffer-invertors 180 connecting to the base of a transistor 182. The transistors are serially chained from ground 183 along their corresponding emitters and collectors to a 12 v biased RC circuit 184 with an OR gate output buffer-invertor 185. By designing modular inputs 178 for the OR gate, the input configuration for the logic circuit 54 can be modified simply by adding or removing one of the receivers.

The object discriminator or two-state threshold-triggered response integrator comprises an RC integrator circuit 186 with a diode 187 defining forward bias and reverse bias threshold values across two parallel sets 188 and 189 of resisters 190. Dip switches 192 serially connect with all but one of the resistors 190 in each set to permit adjustment of both threshold values defined by the resistance across the two sets 188 and 189 of resistors. The override 162, forward biased by a diode 194 connects in parallel to the RC integrator circuit 186 output and the input lead of an integrator buffer invertor 195. The override includes a buffer-invertor 196 to isolate the override switches 163, 164 and 165 from the logic circuit 54 and a 12 v biased RC switching circuit 197 that is grounded by the activation of any one of the override switches 163, 164 and 165 to disable the logic circuit 54.

The power relay 168 includes a power relay input buffer-invertor 198 that isolates a relay switch 199 from the logic circuit 54 and connects at the base of a power transistor 200. The power 24 v load relay switch 199 is comprised of the type Stancor TS-9024A and serially connects to ground across the collector and emitter of the power transmitter. The relay switch connects to the respective gantry motor controllers 62 to disable power to the respective gantry motors.

The two-state two-output alarm-signal generator 172 comprises an input buffer-invertor 202 which connects in parallel circuit to two alarm signal lines 203 and 204 at the base of respective alarm transistors 205 and 206 where the first signal line 203 includes a second alarm buffer-invertor 207 connected in series for inverting the load of the first signal line with respect to the second signal line. An LED 208 connects to the second signal line and acts as an all-clear signal indicator and illuminates upon the second signal line switching to a "low" voltage state. A light 175 and audio 174 alarm serially connect in circuit across the two signal lines forward biased from the second signal line by a diode 209 connected therewith. A second all-clear indicator light 176 also connects across the signal lines forward biased from the first signal line by a diode 210 connected serially therewith. Although described connecting to the light indicators and audio alarm, those skilled in the art will appreciate that the two-state two-output alarm-signal generator may be connected to any type of alarm including a digital voice type alarm where a digitized voice may be programmed to say, "Warning the gantry boom is blocked."

The logic circuit receives power from power lines 211 connecting to the gantry's power supply 60 and includes AC/DC converter 212 defined by diodes in a whetstone bridge and a balanced 24 v. input line 214 and 12 v. output line 216 DC voltage regulator 218.

Operation

Figure 2:
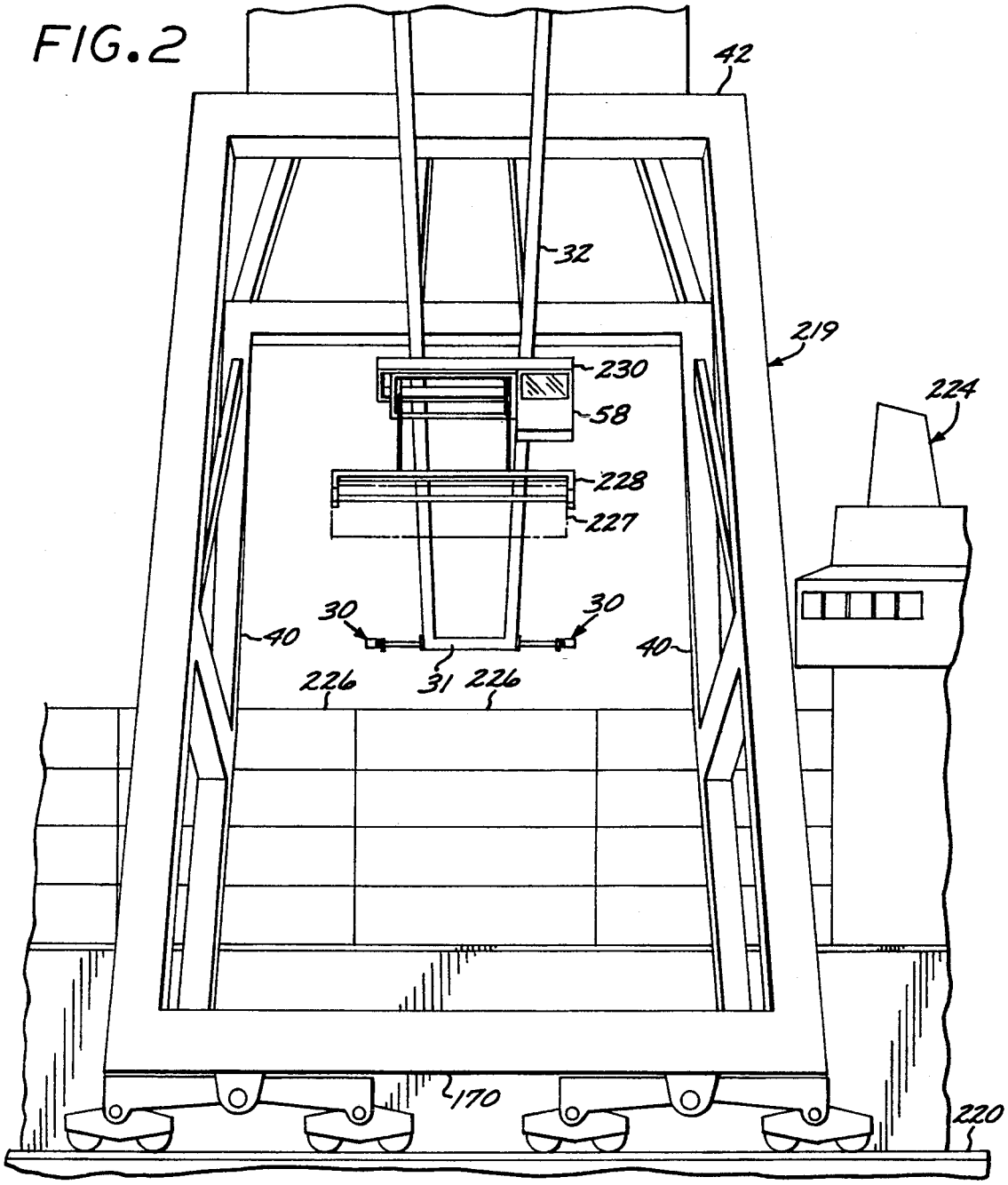
FIG. 2 is a back view of a cargo gantry crane embodying the collision avoidance device of the present invention.
Figure 3:
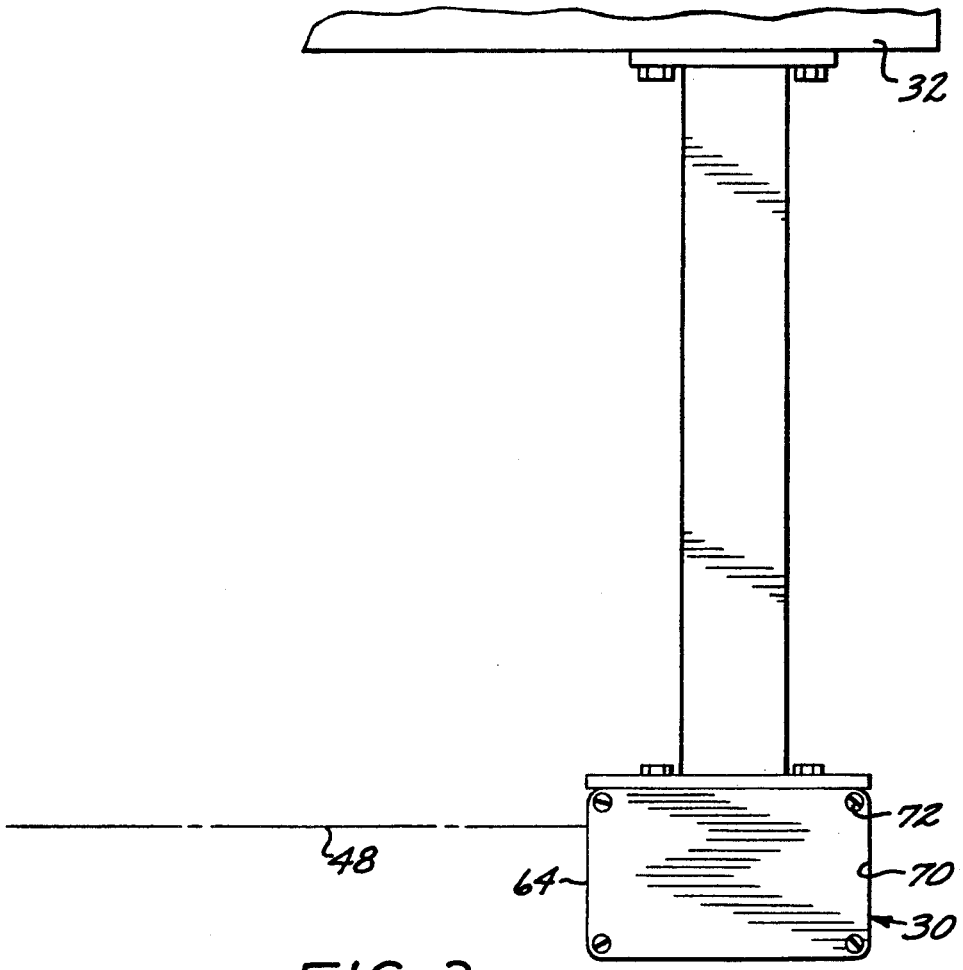
FIG. 3 is a fragmentary top plan view, in enlarged scale, taken along the line 3—3 of FIG. 1.
Figure 4:
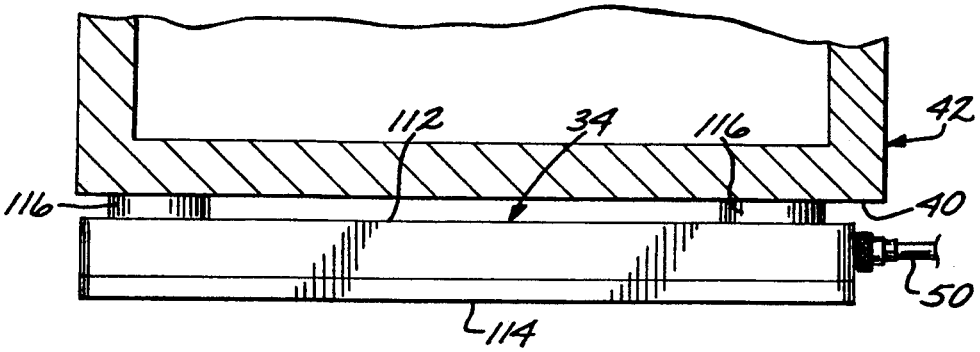
FIG. 4 is a transverse sectional view, in enlarged scale, taken along the line 4—4 of FIG. 1.
Figure 9:
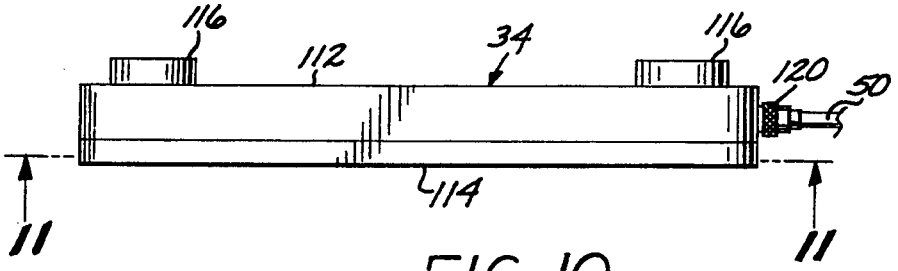
FIG. 9 is a transverse sectional view similar to FIG. 4 showing the top of a receiver.
Figure 10:
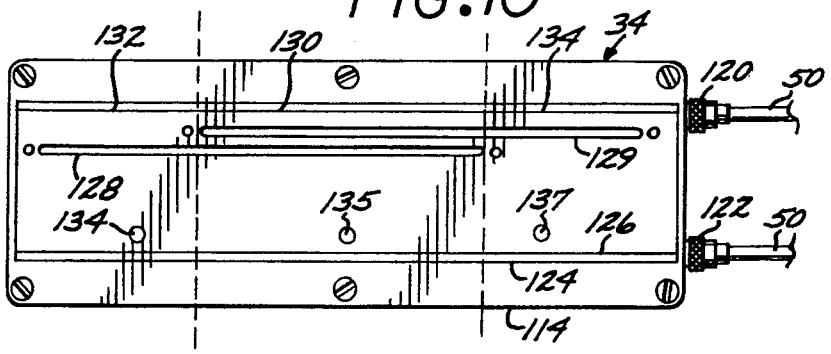
FIG. 10 is a front view of the receiver shown in FIG. 9.
Figure 11:
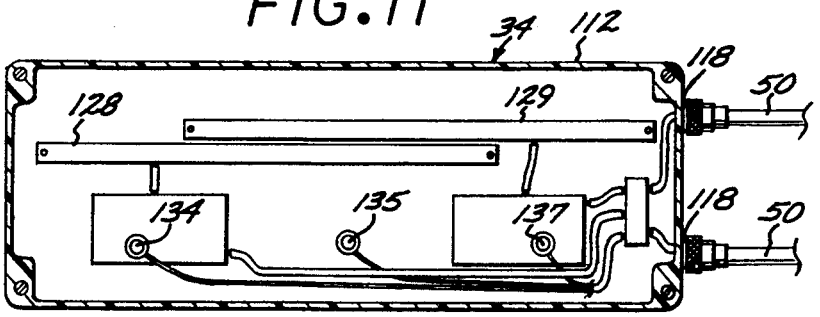
FIG. 11 is a vertical sectional view taken along the line 11—11 of FIG. 9.
Figure 12:
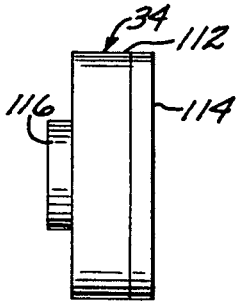
FIG. 12 is a left side view of the shown in FIG. 10 receiver.
Figure 13:
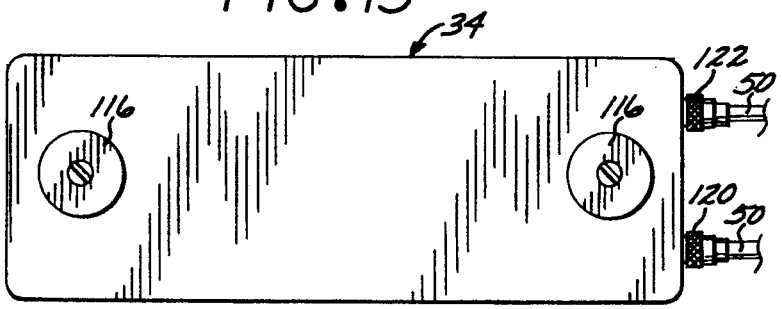
FIG. 13 is a back view of the receiver shown in FIG. 10.

A cargo gantry crane 219 (FIGS. 1 and 2) is carried on rails 220 by a self-propelled wheel-type motor bed 170 that permits travel on the dock 222 laterally alongside a ship 224. The gantry crane moves along the vessel to access all of the cargo holds 226 on the ship. Thus one crane can be utilized to efficiently load or unload cargo 227 on a ship by means of a spreader 228 attached to a trolley 230 that moves along the lengthwise underside of the boom.

Typically, when the crane is about to be moved along the rails, the crane operator's attention is directed to the path along the rails on which the crane will travel. In many models the operator has the option of raising the boom 32 prior to gantry movement along the rail. The free end 31 of the boom may be rotated to a substantially vertical position about a horizontal axis defined by a hinge 232 in front of the tower 42. At the near vertical position, the crane's boom 32 will clear any object projecting vertically from the vessel. In the effort to achieve efficient cargo transfer, the operator typically forgoes raising the boom 32 prior to movement of the gantry crane to thus avoid the associated time delay.

When the boom of the gantry crane is lowered, the transmitters' mercury switch 96 and logic controllers' mercury switch 164 act as inclinometers to activate the present invention. Once activated each of the transmitters 30 generates a sweeping laser beam at 10 RPS tracing interface lines 138 on each of the respective gantry tower legs 40. It may be appreciated by those skilled in the art that a sweeping laser beam not only eliminates the one to one correspondence required for a static laser and receiver configuration (not shown), but the sweeping laser cooperates with the lateral detectors 128 and 129 on the receivers to provide corresponding vertical and horizontal intersecting lines that eliminate alignment errors due to movement of the laser transmitters 30 caused by swaying of the free end of the gantry boom.

The receivers 34, 36 and 38 mounted on each of the tower legs receive the respective laser beam in the form of a laser pulse having a duration of approximately 2 to 3 micro-seconds given a boom length of 120 feet and a 10 RPS laser sweep speed. Each receiver's detectors 128 and 129 (FIG. 14) are operative in response to sensing light to generate a small voltage across the high gain amplifiers 144 and 145. The amplifiers amplify the signal and send an output signal representative of the detector's voltage to the associated pulse discriminators 148 and 149. The pulse discriminator in response to detecting a laser pulse having a reference amplitude, pulse width and frequency is operative to generate a digital "HI" signal to the associated input channels 152 and 153 of a demultiplexer 154. Each digital signal has a sampling rate of 10 Hz, corresponding to the laser pulse frequency, and is continuously transmitted to indicate whether the associated pulse discriminator has detected a pulse during each pulse period. The demultiplexer 154 receives signals from two such pulse discriminators 148 and 149 and in response to the Boolean-type digital inputs is operative to generate an output load on one of four output lines 154–158 (FIG. 16). Three of the output lines 155–157 connect to the three LEDs 135–137 corresponding to the three sensor regions 130, 132 and 134 on the front of the receiver. These LEDs are illuminated by the demultiplexer such that upon the laser pulse being sensed in the center region 130 both pulse discriminators register a "HI" signal causing the corresponding center LED 135 to illuminate. The fourth output line 158 provides a load to a logic controller 52. This load is generated upon the receiver detecting the absence of a laser pulse for any pulse period. Thus each receiver is operative to produce a digital "LOW" signal any time a pulse is detected and produces a digital "HI" signal any time the absence of a pulse is detected.

The receivers 34, 36, and 38 (FIG. 16) mounted on each tower leg connect to the corresponding logic controller 52 through an OR gate 159 which in response to a "HI" signal from any one of the respective receivers is operative to generate a "HI" signal output. The OR gate 159 response time also cycles at 10 Hz as dictated by the timing in the receivers. Once a "HI" signal has been generated by the OR gate 159, the object discriminator begins to count the number of sequentially lost laser pulses along its respective tower leg 42. Since an object such as a ship's mast would block several laser pulses, a threshold level 188 between one and three pulse periods may be set by dip switches 192 on a first resistor set 190 connected with the RC integrator circuit 186 to discriminate a ship's mast over objects which would not generate a response signal at the threshold level. Thus the object discriminator, in response to objects blocking several laser pulses thereby causing a response signal above the threshold level, triggers a control signal. Once a control signal has been generated, the power relay 168 in response to the control signal causes an open circuit at the respective gantry motor controllers 62 to disable the respective gantry drive motors. The alarm signal generator 172, in response to the control signal, acts as a flip-flop to toggle the states of the two alarm leads 203 and 204 thereby generating an alarm signal.

Upon disconnecting the drive motors from the gantry power, the gantry crane will roll to a stop. The detection of an object near the gantry crane must be at a sufficient distance from the boom 32, approximately 8 feet in the preferred embodiment, so that the gantry crane will glide to a stop before colliding with the object that blocked the laser beam from registering on one of the receivers.

Once the boundary paths leading in the direction of travel have been cleared of any obstacles, each logic circuit 54 does not immediately trigger the power relay 168 to reestablish power. Instead a second set of resistors 191 adjustable by dip switches 193 connected therewith causes the object discriminator to delay terminating the control signal for 6 to 30 seconds depending on the dip switch setting. This delay feature ensures that the operator has time to react to manually shutdown the gantry motors and apply brakes if available before power is reestablished.

Further, it will be appreciated by those skilled in the art that a laser with a low diffusion rate ensures the narrow laser signal will be blocked by a narrow mast or other hazardous object compensating for the sway of the overhang.

From the forgoing it will be appreciated that the collision avoidance device of the present invention provides a convenient to install, economical, and reliable apparatus for ensuring the safe movement of a gantry crane with respect to a vessel during the loading and unloading of containers thereon. The device operates to prevent the gantry crane overhang from contacting and causing damage to portions of the vessel that may be within the overhang's lateral path.

Various modifications and changes may be made with regard to the forgoing detailed description without departing from the spirit of the invention.

What is claimed is:

1. A gantry crane collision avoidance apparatus for detecting objects alongside an elongated gantry boom carried on one end from a support tower and terminating in a free end, said apparatus comprising:

a transmitter device mounted on said free end of said boom and including a laser generator for directing a laser beam back along a path defining a boundary alongside at least one side of said boom at said tower to form an interface point on said tower;

at least one receiver device mounted at said interface point and operative in response to the absence of said laser beam to generate a response signal;

an alarm generator connected in circuit with said receiver and responsive to a control signal to generate an alarm signal; and a logic circuit device connected with said receiver device and alarm generator and in response to said operation signal operative to generate said control signal whereby said transmitter device projects said laser beam along said boundary at said interface point such that upon introduction of an object into said boundary, said receiver device will detect the absence of said laser beam to generate said response signal causing said logic circuit device to generate said control signal to activate said alarm generator to generate said alarm signal.

2. A gantry crane collision avoidance apparatus as set forth in claim 1 for use with a gantry crane having a gantry motor serially connected to a gantry power supply including:

a motor bed supporting said tower and including a drive motor for driving said tower in a direction lateral to said boom; and a power relay connected in circuit with said logic circuit device and connected with said gantry motor and power supply for deactivating power to said gantry motor in response to said control signal.

3. A gantry crane collision avoidance apparatus as set forth in claim 2 wherein:

said receiver device in response to detecting the absence of said laser beam due to objects having a collision characteristic operative to generate said response signal having a predetermined characteristic; and said logic circuit device includes an object discriminator connected with said receiver device, said power relay, and alarm generator in response to said response signal having said predetermined characteristic operative to generate said control signal.

4. A gantry crane collision avoidance apparatus as set forth in claim 1 for use with a gantry boom including an elevatable free end wherein:

said logic circuit device includes an override switch carried by said boom and operative in response to elevation of said free end to override said control signal to said alarm generator.

5. A gantry crane collision avoidance apparatus as set forth in claim 1 wherein:

said receiver device includes a plurality of receivers mounted in vertical spaced apart relation along said tower and each receiver in response to the absence of a laser beam operative to generate said response signal;

said transmitter device includes means for generating a laser beam at each of said receivers; and said logic circuit device responsive to said response signal from any one of said receivers operative to generate said control signal.

6. A gantry crane collision avoidance system as set forth in claim 1 wherein:

said transmitter device includes a mount for carrying said laser generator, said mount being configured to move said generator to direct a vertically sweeping laser beam from said generator repeatedly at said tower registering in the form of a laser pulse at said insect point to trace an interface path along said tower during regular intervals;

said receiver device includes a plurality of receivers mounted in vertical spaced apart relation along said interface path to define a plurality of intersect points and, each operative in response to the absence of said laser pulse during regular intervals to generate said response signal; and said logic circuit device is connected with said receivers and response to said response signal from any one of said sensors operative to generate said control signal.

7. A gantry crane collision avoidance system as set forth in claim 1 for use with a tower formed by a pair of laterally spaced apart legs and wherein:

said transmitter device includes a pair of transmitters, each transmitter mounted on either side of said free end of said boom and include respective laser generators directing laser back toward the respective said tower legs to define respective boundaries alongside either side of said boom to strike said tower at respective interface points;

said receiver device includes receivers disposed on said legs at said interface points responding to the absence of said laser beam to generate said response signals; and said logic circuit device includes logic circuits connected with receivers disposed on respective receiver legs.

8. A gantry crane collision avoidance system as set forth in claim 1 wherein:

said transmitter device includes a housing formed with a window, a transparent sheet in said window and a heater mounted in heat exchange relationship with said transparent sheet to evaporate moisture therefrom.

9. A gantry crane collision avoidance system as set forth in claim 1 wherein:

said transmitter device includes an opaque housing formed with a window therein for projection of said laser beam therethrough, said laser beam generator disposed adjacent to said window for viewing there through and a lamp mounted in said housing for illuminating said generator.

10. A gantry crane collision avoidance system as set forth in claim 1 wherein:

said receiver device includes a laterally elongated detector for detecting said laser beam and to accommodate for variation in lateral shifting of said interface point.

11. A gantry crane collision avoidance system as set forth in claim 1 wherein:

said receiver device includes a weather resistant housing and magnetic mounts for mounting said housing from said tower.

12. A gantry crane collision avoidance apparatus to detect obstacles alongside a cantilevered gantry boom carried on one end by a support tower and terminating in a free end, for use with a laterally mobile gantry crane including a gantry motor serially connected to a gantry power supply for driving said crane in a direction laterally perpendicular to said boom, said system comprising:

a transmitter device mounted on said free end of said boom and includes laser beacon for directing a vertically sweeping laser beam back along at least one boundary path defining a danger field on at least one side of said boom to trace an interface line on said tower;

at least one receiver device mounted on said tower on said interface line defining an intersection point and operative in response to the absence of said vertically sweeping laser beam to generate a first response signal; and a logic controller device connected with said receiver device responsive to said operation signal to generate a control signal whereby said transmitter device projects said vertically sweeping laser beam along said boundary plane to trace said interface line such that upon introduction of an obstacle into said boundary path between said transmitter device and receiver device, said receiver device will detect the absence of said laser beam to generate said first response signal causing said control circuit to generate said control signal;

said logic controller device further includes a power relay connected with said gantry motor and gantry power supply operative in response to said control signal to deactivate said gantry motor.

13. A gantry crane collision avoidance apparatus as set forth in claim 12 wherein:

said logic controller device further includes an alarm signal generator operative in response to said control signal to generate an alarm signal.

14. A gantry crane collision avoidance apparatus as set forth in claim 12 wherein:

said receiver device in response to detecting an object having a predetermined characteristic operative to generate a first response signal;

said logic controller device further includes an object discriminator connected in circuit with said receiver device and in response to receiving said first response signal to generate said control signal whereby said transmitter device projects said sweeping laser beam along said boundary plane to said interface line such that upon introduction of an object having a predetermined characteristic into said boundary between said transmitter device and receiver device, said receiver device will detect the absence of said laser beam to generate said first response signal causing said object discriminator to generate said control signal.

15. A gantry crane collision avoidance system as set forth in claim 12 wherein:

said receiver device operative in response to said sweeping laser beam to generate a second response signal; and said logic controller device further includes a delay reset connected with said receiver that in response to said second response signal for a predetermined period of time deactivates said control signal.

16. A gantry crane collision avoidance apparatus as set forth in claim 12 wherein:

an override switch connects to said logic controller device; and said logic controller further includes a control signal override in response to said override switch to deactivate said control signal.

17. A gantry crane collision avoidance apparatus as set forth in claim 12 for use with a gantry crane including an elevatable boom and wherein:

said override switch includes an inclinometer switch coupled with said boom for detecting elevation thereof and responsive to elevation of said free end of said boom to cause said control signal override to deactivate said control signal.

18. A gantry crane collision avoidance apparatus as set forth in claim 12 for use with a gantry crane including an elevatable boom and wherein:

said transmitter device includes an inclinometer switch for disconnecting power thereto in response to elevation of said free end of said boom.

19. A gantry crane collision avoidance system as set forth in claim 12 wherein:

said receiver device includes alignment sensor means for generating an alignment signal in response to sensing the laser beam; and said receiver device includes an indicator mounted thereon in response to said alignment signal operative to indicate a lateral intersection point of said interface line on said receiver whereby said transmitter device projects said sweeping laser beam along said boundary path to trace said interface line and said sensing means in response to sensing said laser beam generates said alignment signal such that said indicator in response to said alignment signal indicates said lateral intersection point of said interface line for laterally centering said receiver therealong.

* * * * *